US009286859B2

(12) United States Patent
Miki et al.

(10) Patent No.: US 9,286,859 B2
(45) Date of Patent: Mar. 15, 2016

(54) BRIGHTNESS MEASUREMENT METHOD AND BRIGHTNESS ADJUSTMENT DEVICE FOR DISPLAY ELEMENTS

(75) Inventors: Yohei Miki, Tokyo (JP); Koji Miyahara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 93 days.

(21) Appl. No.: 14/237,709

(22) PCT Filed: Nov. 25, 2011

(86) PCT No.: PCT/JP2011/006574
§ 371 (c)(1),
(2), (4) Date: Feb. 7, 2014

(87) PCT Pub. No.: WO2013/076781
PCT Pub. Date: May 30, 2013

(65) Prior Publication Data
US 2014/0204110 A1 Jul. 24, 2014

(51) Int. Cl.
*G09G 5/10* (2006.01)
*G09G 3/20* (2006.01)

(52) U.S. Cl.
CPC .. *G09G 5/10* (2013.01); *G09G 3/20* (2013.01); *G09G 2320/0233* (2013.01); *G09G 2320/0626* (2013.01); *G09G 2360/145* (2013.01)

(58) Field of Classification Search
CPC ..... G09G 2320/0233
See application file for complete search history.

(56) References Cited

U.S. PATENT DOCUMENTS

| | | | | |
|---|---|---|---|---|
| 2004/0174323 | A1 | 9/2004 | Yamashita et al. | |
| 2006/0220576 | A1 * | 10/2006 | Lim | 315/169.1 |
| 2010/0123837 | A1 | 5/2010 | Yamashita et al. | |
| 2012/0062621 | A1 * | 3/2012 | Miyahara et al. | 345/690 |

FOREIGN PATENT DOCUMENTS

| | | |
|---|---|---|
| JP | 2004 71557 | 3/2004 |
| JP | 2010 122277 | 6/2010 |
| JP | 2010 139945 | 6/2010 |
| JP | 2010 266502 | 11/2010 |
| JP | 2011 229060 | 11/2011 |

OTHER PUBLICATIONS

International Search Report Issued Feb. 21, 2012 in PCT/JP11/006574 Filed Nov. 25, 2011.

* cited by examiner

*Primary Examiner* — Zhengxi Liu
*Assistant Examiner* — Grace Q Li
(74) *Attorney, Agent, or Firm* — Oblon, McClelland, Maier & Neustadt, L.L.P.

(57) ABSTRACT

In a state in which a reference light source emits light, display elements of a display device are caused to light up in each of lighting patterns for causing any adjacent display elements not to light up simultaneously. A captured image acquirer acquires image data about an image captured in each of the lighting patterns, a display element position calculator determines the position of each of the display elements and the position of the reference light source on each of the images, a display element brightness calculator calculates brightnesses from the pixel values at the determined positions, a relative brightness calculator calculates a relative brightness of each of the display elements with respect to the brightness of the reference light source, and a display element output coefficient calculator calculates coefficients for making the brightnesses of the display elements uniform.

3 Claims, 9 Drawing Sheets

BRIGHTNESS MEASUREMENT METHOD AND BRIGHTNESS ADJUSTMENT DEVICE FOR DISPLAY ELEMENTS

FIELD OF THE INVENTION

The present invention relates to a brightness measurement method of and a brightness adjustment device for measuring the brightnesses of display elements which construct the screen of a display device.

BACKGROUND OF THE INVENTION

In order to display a high quality image on a large screen display constructed of a plurality of display elements, such as LEDs (light emitting diodes), which are arranged therein, the brightnesses of the display elements need to be uniform. However, variations occur in the brightnesses of the display elements due to a difference in the characteristics of each of the display elements. To solve this problem, a driving signal for driving each of the display elements is adjusted to make the brightnesses of the display elements uniform. In order to determine the degree of this adjustment, a measuring technique of detecting the brightness of each display element is required. Conventionally, as a brightness measurement method for use in display devices, there is a technique of capturing an image of a display screen to measure the brightness of each pixel on the captured image (for example, refer to patent reference 1).

RELATED ART DOCUMENT

Patent Reference

Patent reference 1: Japanese Unexamined Patent Application Publication No. 2004-71557

SUMMARY OF THE INVENTION

Problems to be Solved by the Invention

In the technique disclosed by above-mentioned patent reference 1, in order to eliminate the influence of the brightness of an adjacent pixel and to measure the brightness of each pixel correctly, pixels of different colors are caused to light up at times varying from one color to another in such a way that pixels not adjacent to each other can be captured selectively, and therefore an image is captured for each color to measure the brightness of each pixel. A problem is, however, that when the brightness measurement method disclosed by above-mentioned patent reference 1 is applied to a large screen display, a difficulty of measuring the brightness of each pixel in a short time occurs because of the large screen, and a change occurs in outside environments, such as the ambient light, due to the passage of time, and hence variations occur in the measurement results according to the time that the brightness value of each pixel is acquired.

The present invention is made in order to solve the above-mentioned problem, and it is therefore an object of the present invention to provide a technique of preventing variations from occurring between measured brightness values of captured images, thereby improving the accuracy of the measurement.

Means for Solving the Problem

In accordance with the present invention, there is provided a brightness measurement method for display elements, of measuring a brightness of each of display elements which construct a screen of a display device, a display element position calculating step that uses, as an input, a plurality of captured image data which are captured by causing the display elements to light up in each of lighting patterns which are shifted in time in such a way that any adjacent ones of the display elements do not light up simultaneously in a state in which a predetermined reference light source emits light, the number of captured image data being equal to the number of lighting patterns, to determine a position of each of the display elements and a position of the reference light source on each of the captured images; a display element brightness calculating step that calculates the brightness of each of the display elements and a brightness of the reference light source from pixel values at the positions on the captured image which are determined in the display element position calculating step; and a relative brightness calculating step that calculates a relative brightness of each of the display elements with respect to the brightness of the reference light source calculated in the display element brightness calculating step for each of the captured images.

In accordance with the present invention, there is provided a brightness adjustment device for display elements that measures a brightness of each of display elements which construct a screen of a display device, the brightness adjustment device including: a display element position calculator that uses, as an input, a plurality of captured image data about images which are captured by causing the display elements to light up in each of lighting patterns which are shifted in time in such a way that any adjacent ones of the display elements do not light up simultaneously in a state in which a predetermined reference light source emits light, the number of captured image data being equal to the number of lighting patterns, to determine a position of each of the display elements and a position of the reference light source on each of the captured images; a display element brightness calculator that calculates the brightness of each of the display elements and a brightness of the reference light source from pixel values at the positions on the captured image which are determined by the display element position calculator; a relative brightness calculator that calculates a relative brightness of each of the display elements with respect to the brightness of the reference light source calculated by the display element brightness calculator for each of the captured images; and an output coefficient calculator that calculates a coefficient for adjusting a light emission quantity in such a way that the brightnesses of the display elements become uniform on a basis of the relative brightness calculated by the relative brightness calculator.

Advantages of the Invention

The brightness adjustment device in accordance with the present invention can prevent variations from occurring between the measured brightness values of the captured images, thereby being able to improve the measurement accuracy, by calculating the relative brightness of each of the display elements with respect to the brightness of the reference light source for each of the captured images which are obtained by captured the display elements lit in the lighting patterns which are shifted in time. Further, the brightness adjustment device can improve the adjustment accuracy by adjusting the light emission quantity of each of the display elements on the basis of the calculated result of the relative brightness.

EMBODIMENTS OF THE INVENTION

Hereafter, in order to explain this invention in greater detail, the preferred embodiments of the present invention will be described with reference to the accompanying drawings.

Embodiment 1

Figure 1:
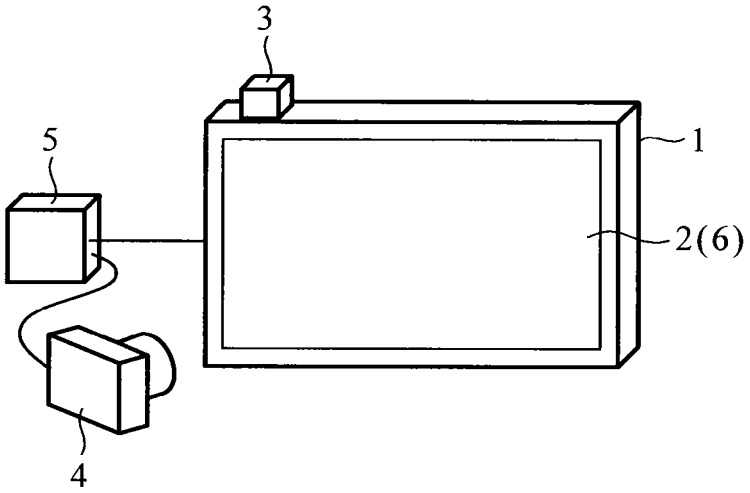
FIG. 1 is a diagram of the whole configuration of a brightness adjustment system to which a brightness adjustment device in accordance with Embodiment 1 of the present invention is applied.

FIG. 1 is a diagram of the whole configuration of a brightness adjustment system to which a brightness adjustment device 5 in accordance with Embodiment 1 is applied. A display device 1 is a large screen display having a display screen 2 in which a plurality of display elements are arranged, and has a reference light source 3 disposed separately from the display elements which construct this display screen 2. As the display elements which construct the display screen 2, and the reference light source 3, LEDs or the like are used. An image capturing device 4 is placed at an arbitrary angle with respect to the display screen 2 and the reference light source 3 of the display device 1. Image data about an image captured by the image capturing device 4 is inputted to the brightness adjustment device 5. The brightness adjustment device 5 consists of, for example, a computer, and measures the brightnesses of the display elements of the display device 1 by using the captured image inputted thereto from the image capturing device 4.

Figure 2:
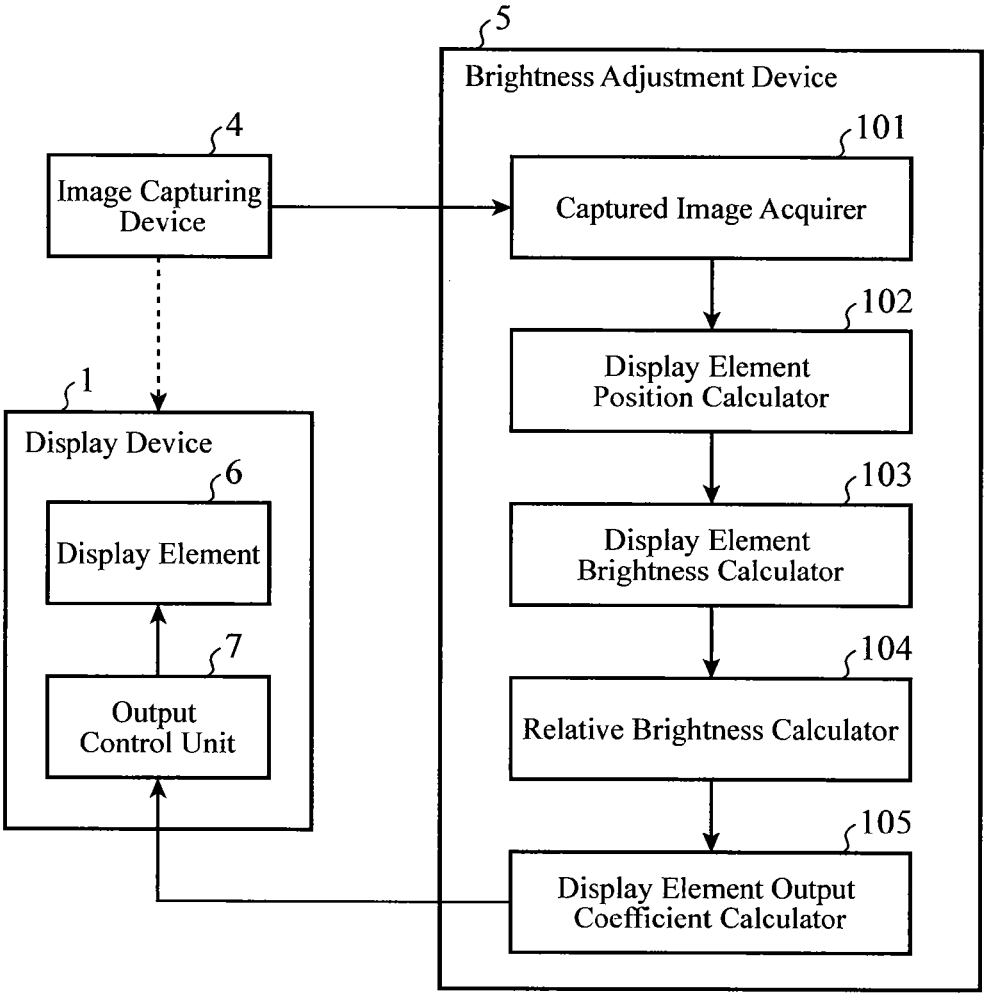
FIG. 2 is a block diagram showing the internal structure of the brightness adjustment device in accordance with Embodiment 1.

FIG. 2 is a block diagram showing the internal structure of this brightness adjustment device 5. The brightness adjustment device 5 includes a captured image acquirer 101 that acquires the image data about the image captured by the image capturing device 4, a display element position calculator 102 that determines the position of each of the display elements 6 of the display device 1 from this captured image, a display element brightness calculator 103 that calculates the brightnesses of the display elements 6 and the brightness of the reference light source 3 on the basis of the position determined on the captured image, a relative brightness calculator 104 that calculates relative brightness values of the display elements 6 with respect to the brightness value of the reference light source 3, and a display element output coefficient calculator 105 that calculates coefficients for adjusting the outputs of the display elements 6 on the basis of the relative brightnesses. The coefficients calculated by the display element output coefficient calculator 105 are inputted to the display device 1. In the display device 1, the output control unit 7 corrects the value of an output signal on the basis of a coefficient, and inputs the output signal corrected thereby to each of the display elements 6 which construct the display screen 2 to make the light emission quantity of each of the display elements 6 uniform and reduce variations in the brightnesses of the display elements.

Figure 3:
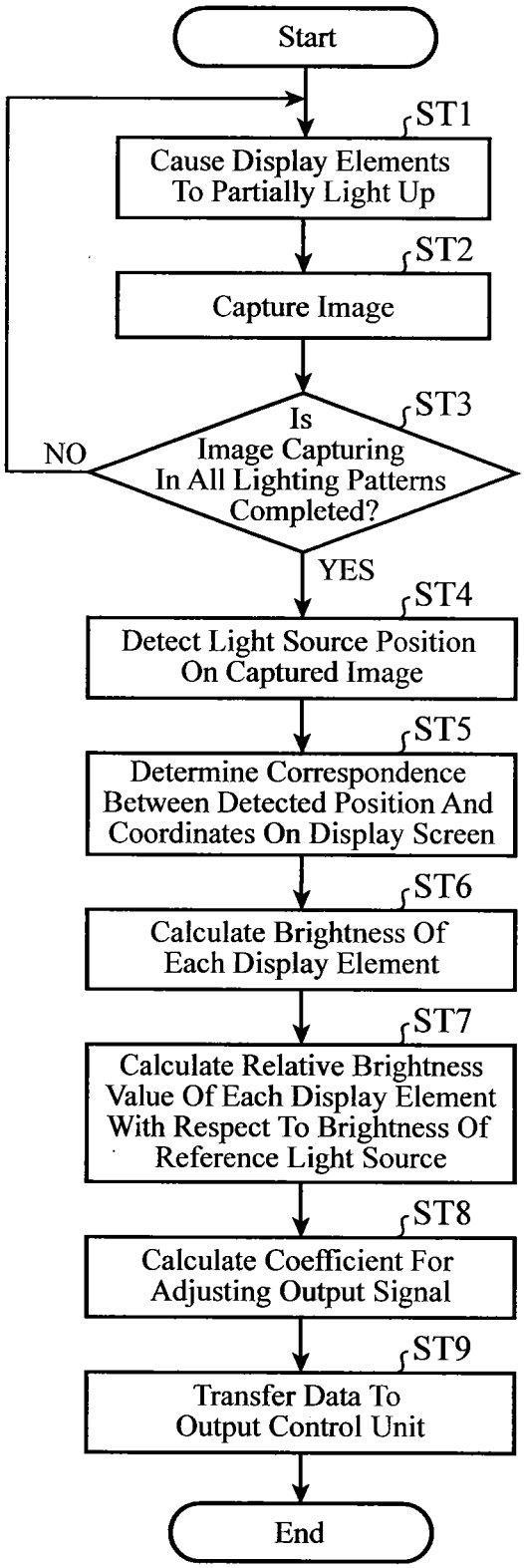
FIG. 3 is a flow chart showing the operation of the brightness adjustment device in accordance with Embodiment 1.

Next, the operation of the brightness adjustment system will be explained. FIG. 3 is a flowchart showing the operation of the brightness adjustment device 5. After the image capturing device 4 is placed in advance at an arbitrary angle with respect to the display device 1 and the reference light source 3, the display elements 6 of the display device 1 are caused to partially light up (step ST1), and the image capturing device 4 is caused to capture an image (step ST2). The reference light source 3 is caused to always light up when the display elements 6 are caused to partially light up. Control of the operations of the display device 1, the reference light source 3, and the image capturing device 4 can be carried out in an arbitrary manner.

Figure 4:
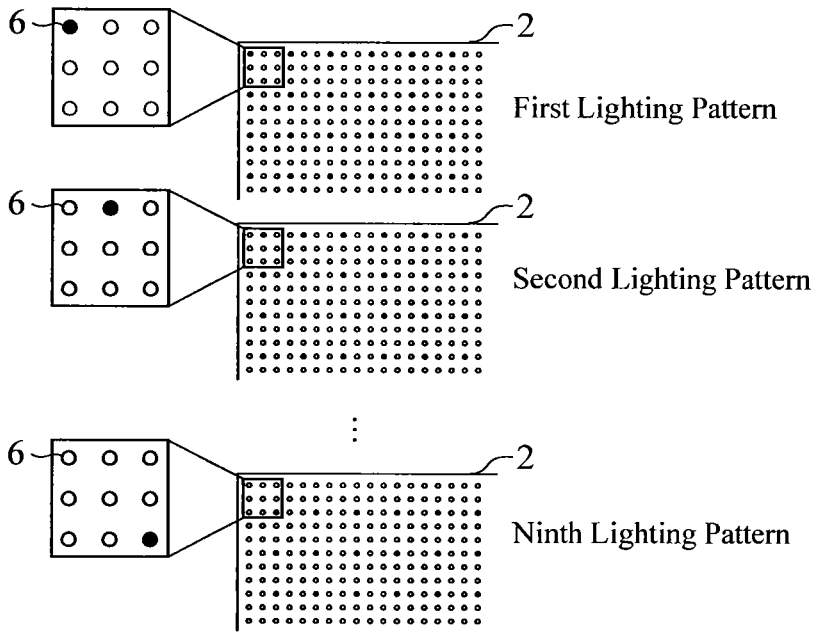
FIG. 4 is a diagram explaining lighting patterns for lighting a display device in accordance with Embodiment 1.

FIG. 4 is a diagram explaining lighting patterns of the display device 1. All the display elements 6 which construct the display screen 2 are divided into groups each consisting a 3×3 array of nine display elements 6 in total. The display elements 6 in each of the groups are caused to light up in each of first through ninth lighting patterns, and an image of the screen is captured for each of the lighting patterns. Therefore, in order to capture an image of all the display elements 6 in each of the groups, the image capturing is repeated nine times. The lighting patterns are not limited to the exemplary ones shown in FIG. 4. The lighting patterns have only to be the ones which are shifted in time in such a way that any two adjacent display element 6 do not light up simultaneously so that the influence of the brightnesses of adjacent display elements 6 can be eliminated.

When the image capturing in the first through ninth lighting patterns is completed ("YES" in step ST3), the captured image acquirer 101 of the brightness adjustment device 5 acquires the image data captured for each of the light patterns from the image capturing device 4. It is needless to say that the captured image acquirer can acquire the captured image data every time when the image capturing in each lighting pattern is completed.

Next, the display element position calculator 102 detects light source positions on the captured image captured for each of the light patterns (step ST4). As light source positions, either the position of each pixel whose brightness is a peak is detected on the basis of the pixel values of the captured image or the position of each pixel whose brightness exceeds a threshold is detected, this brightness value being obtained by carrying out binarization using the threshold on each of the pixel values of the captured image. At this time, the user is allowed to make a distinction between the light source position of the reference light source 3 on the captured image and that of each of the display elements 6 on the captured image by presetting a region where the light source position of the reference light source 3 is planned to be located and a region where the light source position of each of the display elements 6 is planned to be located to the display element position calculator 102. As an alternative, the display element position calculator 102 can recognize the light source position which is detected for all the captured images as the light source position of the reference light source 3.

The display element brightness calculator 103 then determines a correspondence between the light source positions on the captured image detected by the display element position calculator 102 and coordinates on the display screen 2 (step ST5). Then, on the basis of the determined correspondence between the light source positions on the captured image and the coordinates on the display screen 2, the display element brightness calculator estimates the pixel position of each of the display elements 6 on the captured image to calculate the brightness value of the pixel (step ST6). Similarly, the display element brightness calculator estimates the pixel position of the reference light source 3 on the captured image to calculate the brightness value of the pixel.

Next, the relative brightness calculator 104 converts the brightness values of the display elements 6 on the captured image, which are calculated by the display element brightness calculator 103, into relative values with respect to the brightness value of the reference light source 3 on the captured image, which is similarly calculated by the display element brightness calculator 103 (step ST7). The relative brightness calculator 104 calculates the relative brightness value relative_x_y by using equation (1) which will be shown below.

$$\text{relative_}x\text{_}y=\text{brightness_}x\text{_}y/\text{brightness_base} \quad (1)$$

where brightness_x_y is the brightness value of the display element 6 which is calculated from the pixel at the coordinates (x, y) on the captured image, and brightness_base is the brightness value of the reference light source 3 calculated from the pixel on the captured image. As brightness_base, the brightness value of the reference light source 3 which is calculated from a captured image which is obtained by capturing an image by using a lighting pattern for causing the display element 6 at the coordinates (x, y) to light up. Concretely, when nine captured images as shown in FIG. 4 are used, in order to calculate the relative brightness values of the display elements 6 which are caused to light up in the first lighting pattern, the brightness values of the display elements 6 and the brightness value of the reference light source 3 which are calculated from the image captured for the first lighting pattern are used. This is because variations in outside environments (ambient light etc.) resulting from capturing times differing for each captured image are eliminated.

Next, the display element output coefficient calculator 105 calculates a coefficient for adjusting the output signal to drive each of the display elements 6 on the basis of the relative brightness value data of each of the display elements 6 which is calculated by the relative brightness calculator 104 in such a way that each of the display elements 6 emits light having target brightness or emits light having the average of the relative brightnesses of all the display elements 6 which construct the display screen 2 (step ST8). The standard characteristics of the display elements 6 which are used for the display device 1 can be examined in advance and a table showing a correspondence between coefficients and brightnesses (for example, see FIGS. 3 and 6 of patent reference 1) can be generated in advance, and, in this case, the display element output coefficient calculator 105 should just calculate the coefficient by using this correspondence table.

The display element output coefficient calculator 105 then transfers the coefficient data of each of the display elements 6 which is determined in step ST8 to the output control unit 7 of the display device 1 (step ST9). The output control unit 7 corrects the value of the output signal for each of the display elements 6 on the basis of the coefficient data, and drives each of the display elements 6 according to the corrected output signal.

As mentioned above, the brightness adjustment device 5 in accordance with Embodiment 1 is constructed in such a way as to include the captured image acquirer 101 that acquires a plurality of captured image data which are captured by causing the display elements 6 to light up in each of lighting patterns which are shifted in time in such a way that any adjacent display elements 6 do not light up simultaneously in a state in which the reference light source 3, which is disposed separately from the display device 1, emits light, the number of captured image data being equal to the number of lighting patterns, the display element position calculator 102 that determines the positions of the display elements 6 and the position of the reference light source 3 on each of the above-mentioned captured images, the display element brightness calculator 103 that calculates the brightnesses of the display elements 6 and the brightness of the reference light source 3 from the pixel values at the positions on the captured image which are determined by the display element position calculator 102, the relative brightness calculator 104 that calculates the relative brightness values of the display elements 6 with respect to the brightness of the reference light source 3 calculated by the display element brightness calculator 103 for each of the captured images, and the display element output coefficient calculator 105 that calculates coefficients for adjusting light emission quantities on the basis of the relative brightness values calculated by the relative brightness calculator 104 in such a way that the brightnesses of the display elements 6 become uniform. Therefore, the brightness adjustment device can prevent variations from occurring in the measured brightness values of the captured images, thereby being able to improve the measurement accuracy. Further, the brightness adjustment device can improve the adjustment accuracy by adjusting the light emission quantities of the display elements on the basis of the results of the calculation of the relative brightnesses. Therefore, the brightness adjustment device can make the brightness of each display element in a large screen display uniform, and display a high quality image.

Embodiment 2

In above-mentioned Embodiment 1, it is necessary to calculate the relative brightnesses of the display elements with respect to the brightness of the reference light source 3 in order to eliminate variations between the captured images, and therefore the reference light source 3 needs to be disposed separately. In contrast, in this Embodiment 2, the relative brightnesses of display elements 6 are calculated without using a reference light source 3.

Figure 5:
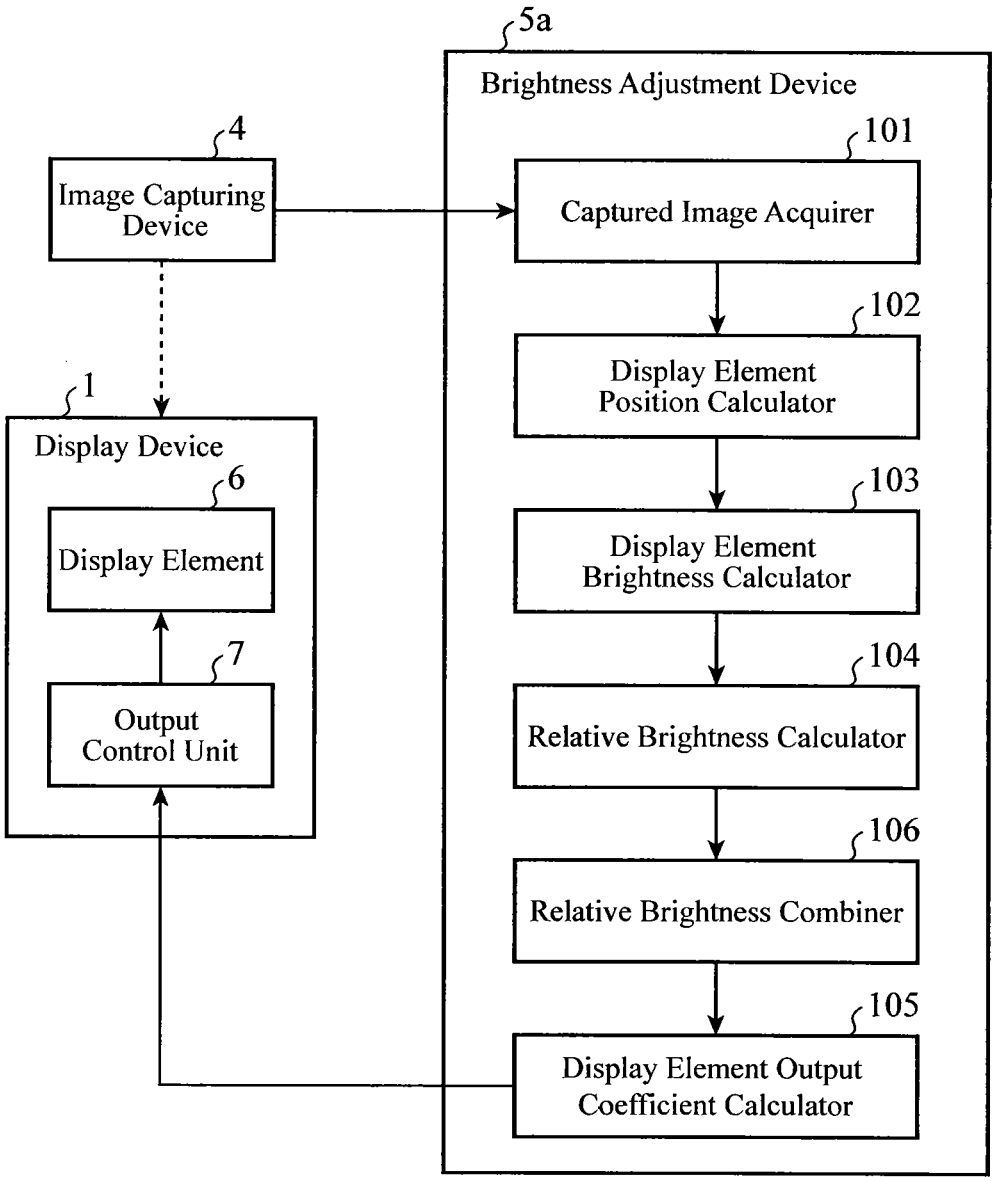
FIG. 5 is a block diagram showing the internal structure of a brightness adjustment device in accordance with Embodiment 2 of the present invention.

FIG. 5 is a block diagram showing the internal structure of a brightness adjustment device 5*a* in accordance with this Embodiment 2. In FIG. 5, the same components as those shown in FIG. 2 or like components are designated by the same reference numerals, and the explanation of the components will be omitted hereafter. This brightness adjustment device 5*a* is newly provided with a relative brightness combiner 106. Further, because a brightness adjustment system in accordance with this Embodiment 2 has a structure in which the reference light source 3 of the brightness adjustment system shown in FIG. 1 is eliminated, the brightness adjustment system will be explained hereafter by using FIG. 1.

Figure 6:
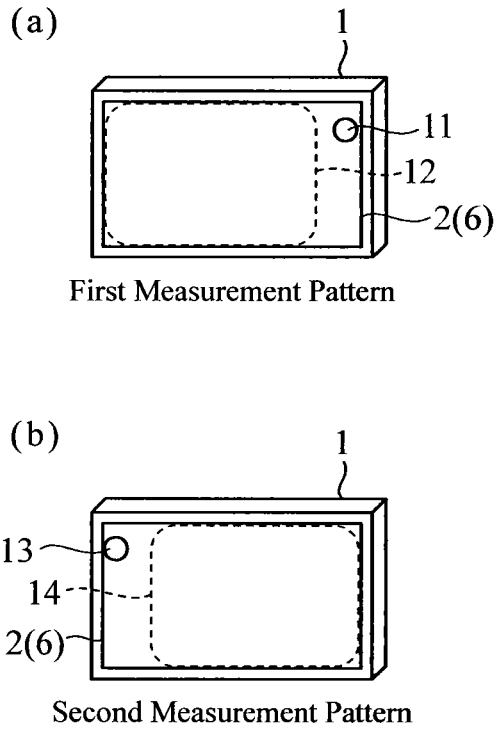
FIG. 6 is a diagram explaining lighting patterns for lighting a display device in accordance with Embodiment 2.

FIG. 6 is a diagram explaining lighting patterns of a display device 1. As shown in FIG. 6(*a*), an arbitrary region is selected from all display elements 6 which construct a display screen 2 and is set as a first reference light source region 11, and the display elements 6 placed in the first reference light source region 11 are handled as a reference light source. At this time, the first reference light source region 11 can include a single display element 6 or a plurality of display elements 6. A first partially lighting region 12 is further set from the region other than the first reference light source region 11. The display elements 6 placed in this first partially lighting region 12 are caused to light up in lighting patterns as explained in above-mentioned Embodiment 1 (e.g., in patterns in which the display elements 6 in each group are caused to light up in an arbitrary order with the display screen being divided into groups each consisting a 3×3 array of nine display elements 6 in total) in such a way that any two adjacent display element 6 do not light up simultaneously and hence light up at time intervals, and an image of the screen is captured. As a result, a captured image group which is one set of nine captured images is acquired. The pattern shown in FIG. 6(*a*) is defined as a first measurement pattern.

However, because the use of only the single group of captured images cannot measure the brightness of the whole of the display screen 2 of the display device 1, a region different from the first reference light source region 11 is selected from all the display elements 6 which construct the display screen 2 and is set as a second reference light source region 12, and a second partially lighting region 14 is further set from the region other than the second reference light source region 13, as shown in FIG. 6(*b*). Then, like in the case in which the first reference light source region 11 and the first partially lighting region 12 are defined, the display elements are caused to partially light up and a further group of captured images is acquired. The pattern shown in FIG. 6(*b*) is defined as a second measurement pattern. The brightness adjustment device 5*a* carries out measurements in both of the first and second measurement patterns, and finally prepares two groups of captured images.

Figure 7:
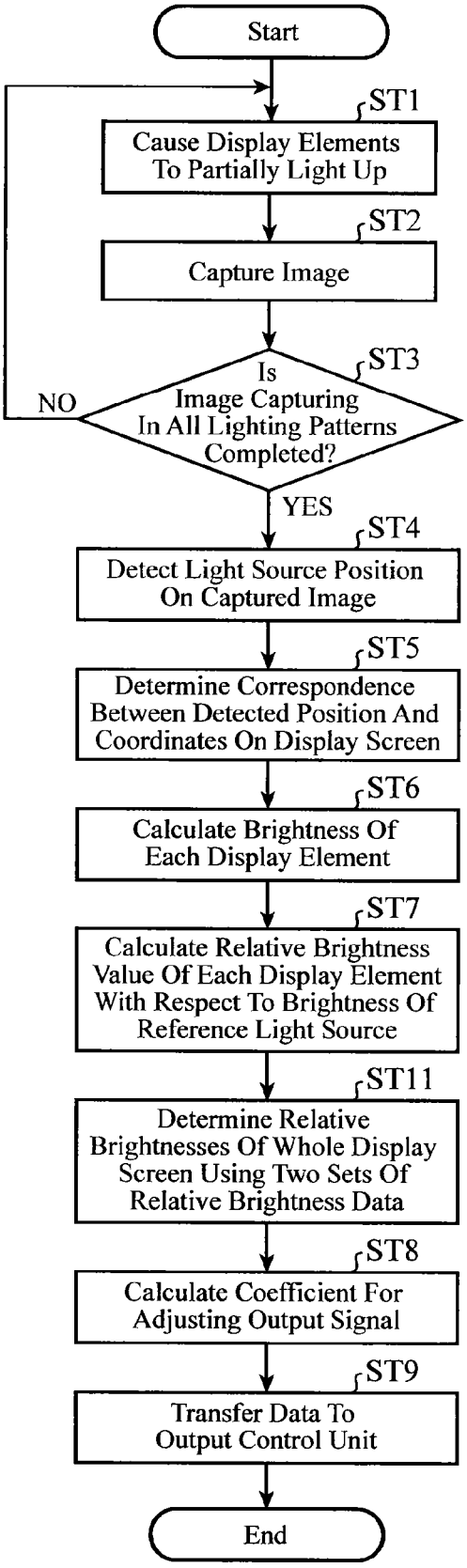
FIG. 7 is a flow chart showing the operation of the brightness adjustment device in accordance with Embodiment 2.

Next, the operation of the brightness adjustment system will be explained. FIG. 7 is a flow chart showing the operation of the brightness adjustment device 5*a*. After an image capturing device 4 is placed in advance at an arbitrary angle with respect to the display device 1, the display elements 6 in the first partially lighting region 12 of the display device 1 are caused to partially light up (step ST1), and the image capturing device 4 is caused to capture an image (step ST2). The display elements 6 in the first reference light source region 11 are caused to always light up when the display elements 6 in the first partially lighting region 12 are caused to partially light up. The display elements 6 in the second partially lighting region 14 are caused to partially light up in the same way (step ST1), and the image capturing device 4 is caused to capture an image (step ST2). The display elements 6 in the second reference light source region 13 are caused to always light up when the display elements 6 in the second partially lighting region 14 are caused to partially light up.

After the image capturing for all the lighting patterns is completed for each of the first and second measurement patterns ("YES" in step ST3), a captured image acquirer 101 of the brightness adjustment device 5*a* acquires the two groups of captured images from the image capturing device 4.

In next steps ST4 to ST7, the brightness adjustment device 5*a* carries out the same processes as those shown in steps ST4 to ST7 of FIG. 3 for each of the captured image groups to calculate both a relative brightness value of each of the display elements 6 in the first partially lighting region 12 with respect to the brightness value of the first reference light source region 11 and a relative brightness value of each of the display elements 6 in the second partially lighting region 14 with respect to the brightness value of the second reference light source region 13.

Figure 8:
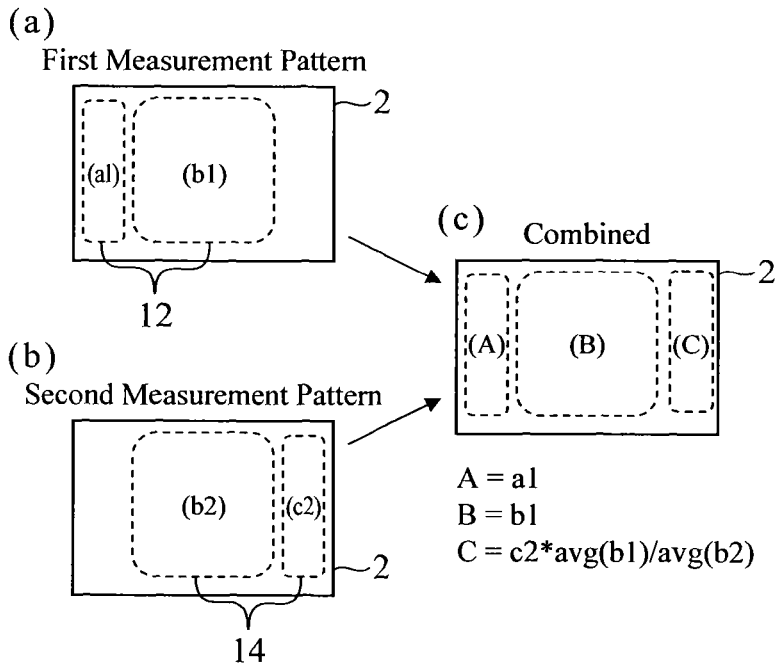
FIG. 8 is a diagram explaining a brightness relative value combining method for use in the brightness adjustment device in accordance with Embodiment 2.

Next, the relative brightness combiner 106 calculates the relative brightness values of all the display elements 6 of the display screen 2 by combining the two sets of relative brightness value data (step ST11). Hereafter, a method of combining the relative brightness values will be explained by using FIG. 8. FIG. 8(*a*) shows the display screen 2 in which the first partially lighting region 12 is set for the first measurement pattern, and FIG. 8(*b*) shows the display screen 2 in which the second partially lighting region 14 is set for the second measurement pattern. A region overlapping the second partially lighting region 14 in the first partially lighting region 12 and a region overlapping the first partially lighting region 12 in the second partially lighting region 14 are defined as combined reference regions b1 and b2 respectively. Regions a1 and c2 are the ones in each of which only a single set of relative brightness value data is provided. FIG. 8(*c*) shows the display screen 2 in which the relative brightness value data acquired for the first measurement pattern are combined with those acquired for the second measurement pattern.

The relative brightness combiner 106 calculates the average avg(b1) of the relative brightness values of the display elements 6 calculated from the combined reference region b1. The relative brightness combiner similarly calculates the average avg(b2) of the relative brightness values of the display elements 6 calculated from the combined reference region b2. The relative brightness combiner then converts the relative brightness values in the region c2 for the second measurement pattern into relative brightness values C for the first measurement pattern on the basis of the averages avg(b1) avg(b2) by using the following equation (2). As other relative brightness values A and B, the relative brightness values in the regional and the relative brightness values in the region b1 are used just as they are.

$$A=a1$$

$$B=b1$$

$$C=c2\times\mathrm{avg}(b1)/\mathrm{avg}(b2) \quad (2)$$

In next steps ST8 and ST9, the brightness adjustment device 5*a* carries out the same processes as those shown in steps ST8 and ST9 of FIG. 3 by using the combined relative brightness value data to calculate coefficients for adjusting output signals, and transfers these output signals to an output control unit 7.

Although the case in which the two positions of the reference light source which are the first reference light source region 11 and the second reference light source region 13 are defined is explained in the above-mentioned example, three or more reference light source regions can be alternatively defined and measurements can be carried out.

As mentioned above, the brightness adjustment device 5*a* in accordance with Embodiment 2 is constructed in such a way that either of the display elements 6 in the first reference light source region 11 of the display screen 2 and the display elements 6 in the second reference light source region 13 of the display screen 2 is defined as the reference light source, the display elements 6 in either of the first partially lighting region 12 and the second partially lighting region 14 are caused to light up in each of lighting patterns which are shifted in time in such a way that any adjacent display elements 6 do not light up simultaneously in a state in which the above-mentioned reference light source emits light, and the brightness adjustment device includes the relative brightness combiner 106 that uses, as an input, captured image data acquired for the first measurement pattern and captured image data acquired for the second measurement pattern, and combines the relative brightnesses of the display elements 6 which are calculated from the captured image data acquired for the first measurement pattern by the relative brightness calculator 104 and the relative brightnesses of the display elements 6 which are calculated from the captured image data acquired for the second measurement pattern by the relative brightness calculator 104 to interpolate the relative brightnesses of the display elements 6 in the first reference light source region 11, and the display element output coefficient calculator 105 calculates the coefficients for adjusting the light emission quantities in such a way that the brightnesses of the display elements 6 become uniform on the basis of the relative brightnesses into which the two sets of relative brightnesses are combined by the relative brightness combiner 106. Therefore, the brightness adjustment device can carry out the brightness measurements and the brightness adjustment with a high degree of precision without using a reference light source 3 disposed separately from the display device 1.

Embodiment 3

Because the table showing the correspondence between the coefficients for adjusting the output signals for driving the display elements 6 and brightnesses is generated on the basis of the standard characteristics of the display elements 6 which are the target for adjustment in above-mentioned Embodiments 1 and 2, when the display elements 6 of the display device 1 have characteristics different from the standard characteristics, the brightnesses of the display elements cannot be adjusted to the intended ones even if the coefficients calculated from the measurement results are used. To solve this problem, in accordance with this Embodiment 3, after the brightness of a display device 1 is adjusted by using the method in accordance with above-mentioned Embodiment 1 or 2, a captured image is acquired again and the results of the adjustment are analyzed, and coefficients for output signals are adjusted finely. When these coefficients are calculated, both coefficients and relative brightness values before the adjustment, and the coefficients and the relative brightness values after the adjustment are used to determine coefficients for further making a fine adjustment after this adjustment.

Figure 9:
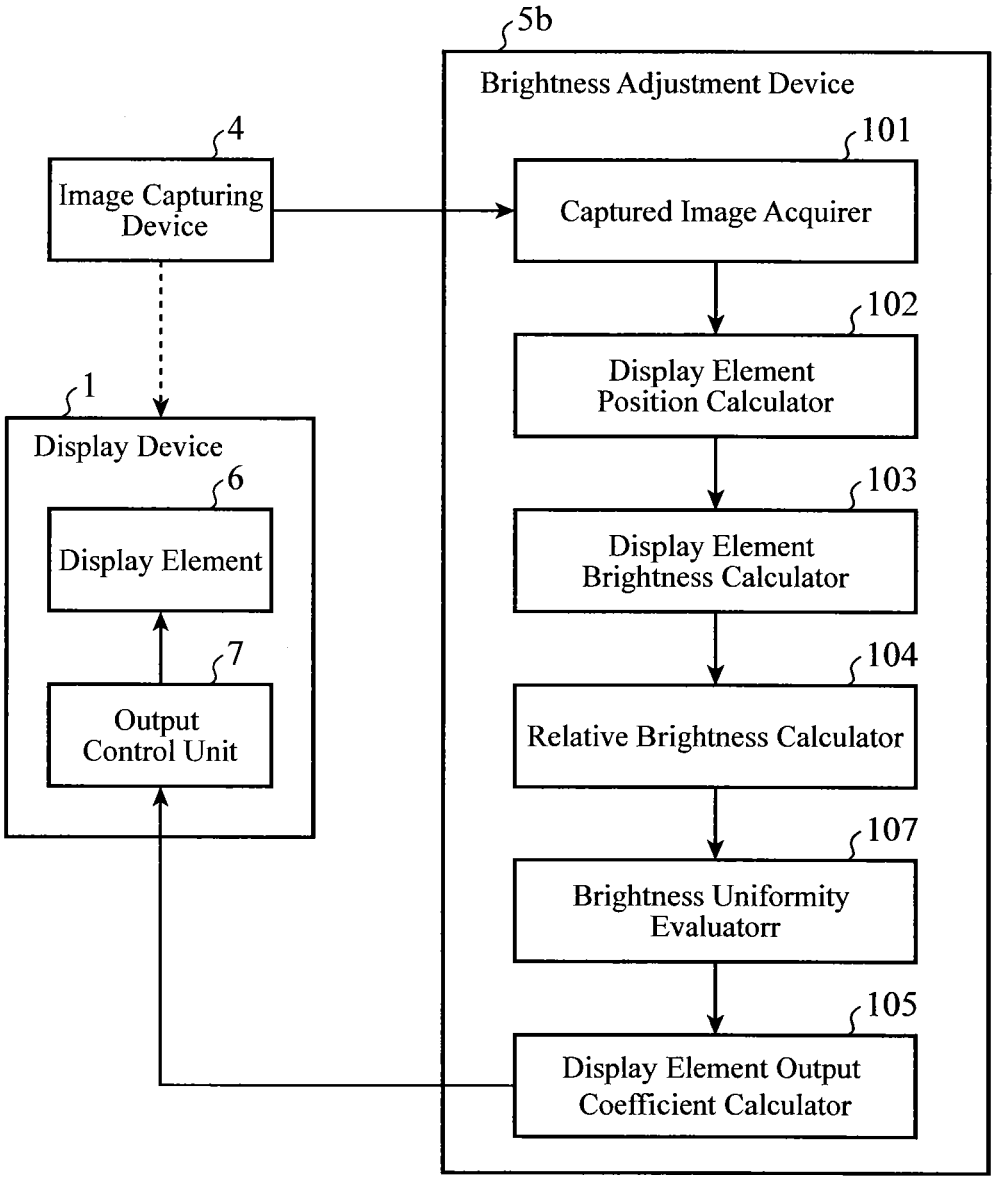
FIG. 9 is a block diagram showing the internal structure of the brightness adjustment device in accordance with Embodiment 3 of the present invention.

FIG. 9 is a block diagram showing the internal structure of a brightness adjustment device 5*b* in accordance with this Embodiment 3. In FIG. 9, the same components as those shown in FIG. 2 or like components are designated by the same reference numerals, and the explanation of the components will be omitted hereafter. This brightness adjustment device 5*b* is newly provided with a brightness uniformity evaluator 107. Further, because a brightness adjustment system in accordance with this Embodiment 3 has the same structure as the brightness adjustment system shown in FIG. 1, the brightness adjustment system will be explained hereafter by using FIG. 1.

Figure 10:
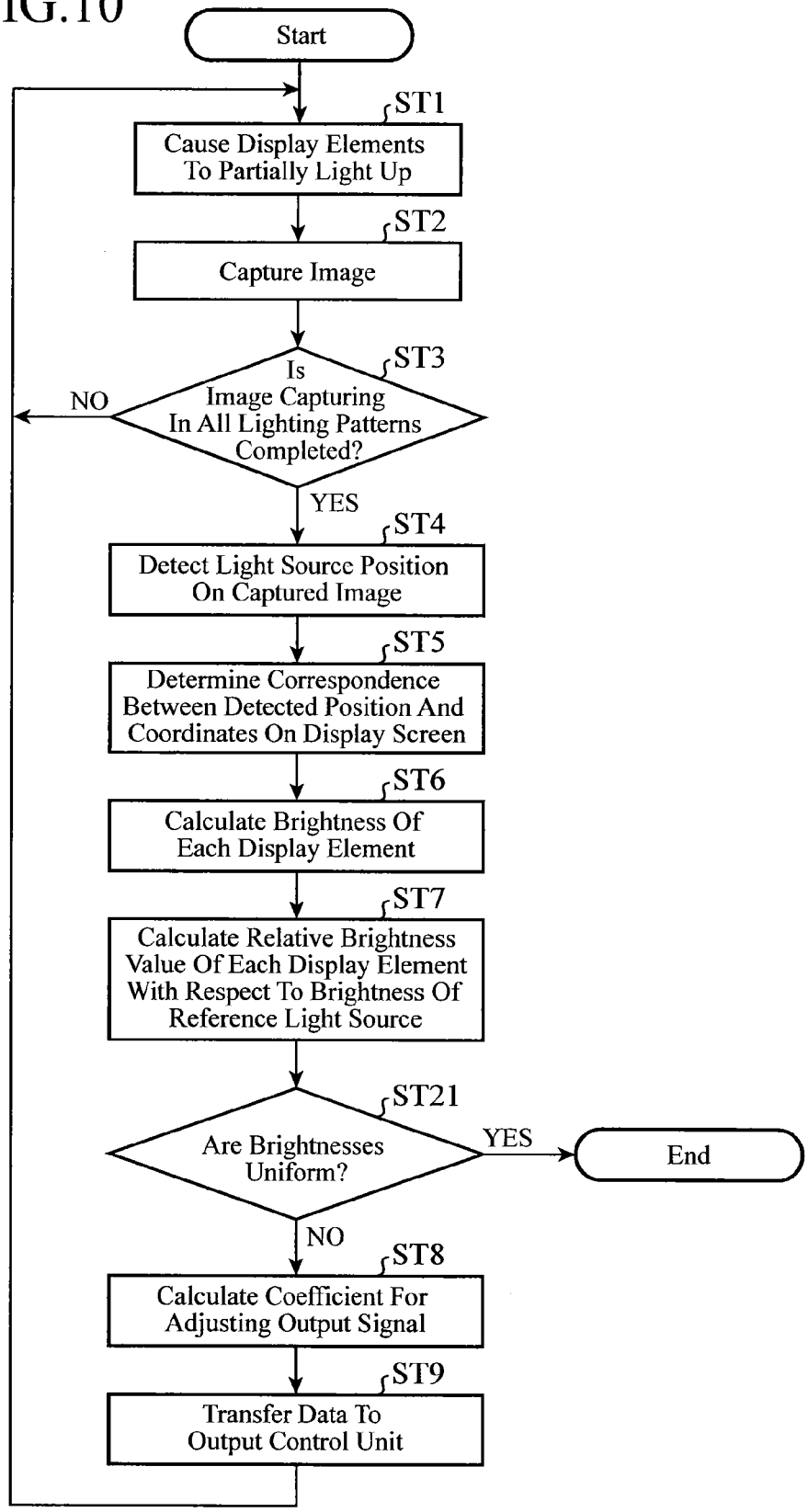
FIG. 10 is a flow chart showing the operation of the brightness adjustment device in accordance with Embodiment 3.

FIG. 10 is a flow chart showing the operation of the brightness adjustment device 5*b*. In steps ST1 to ST7, the brightness adjustment device 5*b* carries out the same processes in steps ST4 to ST7 of FIG. 3 to calculate a relative brightness value of each of display elements 6 of a display screen 2.

The brightness uniformity evaluator 107 then checks whether or not the relative brightness values of the display elements 6 are uniform (step ST21), and, when the relative brightness values are uniform (when "YES" in step ST21), the brightness adjustment device ends the processing without making a brightness adjustment to the display device 1. As a method of checking whether or not the relative brightness values are uniform, any method, such as a method of determining whether the relative brightness values (or the standard deviation of the values or the like) of all the display elements 6 fall within a permissible range, can be used.

In contrast, when the relative brightness values are not uniform (when "NO" in step ST21), a display element output coefficient calculator 105 calculates coefficients for adjusting output signals for driving the display elements 6 (step ST8). At this time, the display element output coefficient calculator calculates new coefficients co_new for fine adjustment according to the following equation (3) by using the calculated coefficients after a brightness measurement is carried out for the second time.

$$\text{co_new} = (\text{co_now} - \text{co_pre}) / (\text{br_now} - \text{br_pre}) \times (\text{br_target} - \text{br_pre}) + \text{co_pre} \quad (3)$$

where br_pre is the relative brightness value at the time of the previous measurement, co_pre is the coefficient at the time of the previous measurement, br_now is the relative brightness value at the time of the current measurement, co_now is the coefficient at the time of the current measurement, and br_target is the average of the relative brightness values of the display elements 6.

As a result, after the brightness measurement is carried out for the second or subsequent time, a coefficient co_new which makes the relative brightness value of each display element 6 deviating from the average br_target of the relative brightness values equal to this average br_target is determined. The display element output coefficient calculator 105 then transfers the coefficient co_new (coefficient co_now at the first-time brightness measurement) of each display element 6 which is calculated by the brightness uniformity evaluator 107 to an output control unit 7 (step ST9). The brightness adjustment device 5*b* then returns to step ST1, and carries out the brightness measurement again.

Although the case in which the fine adjustment method in accordance with Embodiment 3 is applied to above-mentioned Embodiment 1 is shown as an example in the above-mentioned explanation, the fine adjustment method can be alternatively applied to above-mentioned Embodiment 2.

As mentioned above, the brightness adjustment device 5*b* in accordance with Embodiment 3 is constructed in such a way that the brightness adjustment device includes the brightness uniformity evaluator 107 that evaluates whether the brightnesses of the display elements 6 which construct the display screen 2 are uniform on the basis of the relative brightnesses calculated by the relative brightness calculator 104, and the display element output coefficient calculator 105 calculates the coefficients for adjusting the light emission quantities in such a way that the brightnesses of the display elements 6 become uniform when the brightness uniformity evaluator 107 evaluates that the brightnesses of the display elements 6 are not uniform. Therefore, by repeatedly carrying out the measurement of the brightnesses to make a fine adjustment, the brightness adjustment device finally brings the brightnesses of the display elements 6 to a state in which the brightnesses are more uniform, so that the display screen 2 can display a high quality image.

While the invention has been described in its preferred embodiments, it is to be understood that an arbitrary combination of two or more of the above-mentioned embodiments can be made, various changes can be made in an arbitrary component in accordance with any one of the above-mentioned embodiments, and an arbitrary component in accordance with any one of the above-mentioned embodiments can be omitted within the scope of the invention.

INDUSTRIAL APPLICABILITY

As mentioned above, because according to the brightness measurement method and the brightness adjustment device in accordance with the present invention, the relative brightnesses of the display elements of the display device with respect to the brightness of the reference light source are calculated, the brightness measurement method and the brightness adjustment device are suitable for use in a measurement of a wide range of brightnesses, an adjustment of brightnesses, etc., such as a measurement and an adjustment for an LED large screen display.

EXPLANATIONS OF REFERENCE NUMERALS

1 display device, 2 display screen, 3 reference light source, 4 image capturing device, 5, 5*a*, and 5*b* brightness adjustment device, 6 display element, 7 output control unit, 11 and 13 reference light source region, 12 and 14 partially lighting zone, 101 captured image acquirer, 102 display element position calculator, 103 display element brightness calculator, 104 relative brightness calculator, 105 display element output coefficient calculator, 106 relative brightness combiner, 107 brightness uniformity evaluator.

The invention claimed is:

1. A brightness measurement method for display elements, of measuring a brightness of each of display elements which construct a screen of a display device, said method comprising:

a display element position calculating step that uses, as an input, a plurality of captured image data about images which are captured by causing the display elements to light up in each of lighting patterns which are shifted in time in such a way that any adjacent ones of said display elements do not light up simultaneously in a state in which a predetermined reference light source emits light, the number of captured image data being equal to the number of lighting patterns, to determine a position of each of said display elements and a position of said reference light source on each of said captured images;

a display element brightness calculating step that calculates the brightness of each of said display elements and a brightness of said reference light source from pixel values at the positions on said captured image which are determined in said display element position calculating step; and a relative brightness calculating step that calculates a relative brightness of each of said display elements with respect to the brightness of said reference light source calculated in said display element brightness calculating step for each of said captured images, wherein the captured image data used as the input are data about the plurality of captured image data about images which are captured by defining display elements in an arbitrary region of the screen of the display device as the reference light source and causing display elements in a region other than said arbitrary region to light up in each of the lighting patterns which are shifted in time in such a way that any adjacent display elements do not light up simultaneously in the state in which said reference light source emits light while changing the region defined as said reference light source, and said brightness measurement method includes a relative brightness combining step of combining the relative brightness of each of said display elements which is calculated from each of the plurality of captured image data in the relative brightness calculating step to interpolate a relative brightness of each of the display elements in the region defined as said reference light source.

2. A brightness adjustment device for display elements that measures a brightness of each of display elements which construct a screen of a display device, said brightness adjustment device comprising:

a display element position calculator that uses, as an input, a plurality of captured image data about images which are captured by causing the display elements to light up in each of lighting patterns which are shifted in time in such a way that any adjacent ones of said display elements do not light up simultaneously in a state in which a predetermined reference light source emits light, the number of captured image data being equal to the number of lighting patterns, to determine a position of each of said display elements and a position of said reference light source on each of said captured images;

a display element brightness calculator that calculates the brightness of each of said display elements and a brightness of said reference light source from pixel values at the positions on said captured image which are determined by said display element position calculator;

a relative brightness calculator that calculates a relative brightness of each of said display elements with respect to the brightness of said reference light source calculated by said display element brightness calculator for each of said captured images; and an output coefficient calculator that calculates a coefficient for adjusting a light emission quantity in such a way that the brightnesses of said display elements become uniform on a basis of said relative brightness calculated by said relative brightness calculator, wherein the captured image data used as the input are data about the plurality of captured image data about images which are captured by defining display elements in an arbitrary region of the screen of the display device as the reference light source and causing display elements in a region other than said arbitrary region to light up in each of the lighting patterns which are shifted in time in such a way that any adjacent display elements do not light up simultaneously in the state in which said reference light source emits light while changing the region defined as said reference light source, and said brightness adjustment device includes a relative brightness combiner that combines the relative brightness of each of said display elements which is calculated from each of the plurality of captured image data by the relative brightness calculator to interpolate a relative brightness of each of the display elements in the region defined as said reference light source, and the output coefficient calculator calculates the coefficient for adjusting the light emission quantity of each of the display elements on a basis of a relative brightness into which the plurality of relative brightnesses are combined by said relative brightness combiner.

3. The brightness adjustment device according to claim 2, wherein said brightness adjustment device includes a brightness uniformity evaluator that evaluates whether or not the brightnesses of the display elements which construct the screen are uniform on a basis of the relative brightness calculated by the relative brightness calculator, and the output coefficient calculator calculates the coefficient for adjusting the light emission quantity of each of said display elements when said brightness uniformity evaluator evaluates that the brightnesses of said display elements are not uniform.

* * * * *